United States Patent [19]

Temme et al.

[11] Patent Number: 4,498,986

[45] Date of Patent: Feb. 12, 1985

[54] VIBRATORY CONTAINER FOR FLOCCULATION OF THE WASTE WATER OBTAINED UPON VIBRATORY ABRASIVE FINISHING

[75] Inventors: Karl Temme, Wuppertal; Klaus Beckschäfer, Kaarst; Helmut Prüller, Haan, all of Fed. Rep. of Germany

[73] Assignee: Carl Kurt Walther GmbH & Co. KG, Wuppertal, Fed. Rep. of Germany

[21] Appl. No.: 471,107

[22] Filed: Mar. 1, 1983

[30] Foreign Application Priority Data

Jun. 3, 1982 [DE] Fed. Rep. of Germany ..... 3208113

[51] Int. Cl.[3] ..... C02F 1/52

[52] U.S. Cl. ..... 210/199; 210/205; 210/251; 366/128; 366/184

[58] Field of Search ..... 210/205, 206, 208, 209, 210/219, 305, 521, 512.1, 787, 801, 199, 251; 209/446; 366/128, 184

[56] References Cited

U.S. PATENT DOCUMENTS

| | | | |
|---|---|---|---|
| 3,630,368 | 12/1971 | Lee | 210/521 |
| 3,837,494 | 9/1974 | Stevenson | 210/305 |
| 3,893,921 | 7/1975 | Walther et al. | 210/206 |
| 4,067,814 | 1/1978 | Surakka et al. | 210/512.1 |

*Primary Examiner*—Peter Hruskoci

*Attorney, Agent, or Firm*—Martin A. Farber

[57] ABSTRACT

A vibratory container for flocculating waste water obtained upon vibratory abrasive finishing or the like, having an outlet and a feed connection which continues into a feed channel which extends into the inside of the container and is arranged in siphon-like manner with respect to the outlet pipe. For improved treatment of even chemically complex working liquids, the inside of the container is subdivided by partition walls into a plurality of chambers arranged one downstream of the other in the direction of flow. Connections are associated with the first two chambers arranged downstream of the feed channel within the initial region of the flow. The connections serve to introduce flocculation preparation chemicals, while a final connection is provided for the addition of the flocculating agent.

15 Claims, 4 Drawing Figures

VIBRATORY CONTAINER FOR FLOCCULATION OF THE WASTE WATER OBTAINED UPON VIBRATORY ABRASIVE FINISHING

The present invention relates to a vibratory container for flocculating waste water obtained upon vibratory abrasive finishing of the like, having a discharge pipe and a feed connection which communicates with a feed channel which extends into the inside of the container and is associated in siphon-like manner with an outlet, the container having a connection for the addition of the flocculating agent.

Such a development is known from West German Patent No. 2,243,092, the feed channel being developed as a pipe which extends into the inside of the container. The purpose of the pipe is to bring the liquid entering from the feed connection as close as possible to the bottom of the container, namely into the region of a connection provided there for the addition of the flocculating agent. The range of use of such a container is, however, limited since complex working liquids cannot be treated sufficiently.

The object of the present invention is to provide a container of this type which is of simple construction and provides better treatment of the waste water obtained particularly in the case of vibratory abrasive finishing, in such a way that even in the case of chemically complex working liquids they are ready for sewer system treatment.

This object is achieved by dividing the inside of the container into a plurality of chambers arranged downstream of the feed channel in the direction of flow and providing connections which communicate with the chambers in their initial regions of the flow, with first of these connections serving for the introduction of flocculation preparation chemicals while the last connection serves for the addition of the flocculating agent.

As a result of this development there is provided a container of this type of increased value in use. Now even chemically complex working liquids can be treated in such a manner that they are ready for the sewer system after passage through the vibrating container. This means that the solids must still be removed, by either settling or filtering devices. The liquid flowing into the container through the feed channel is subjected to a chemical process upon passing the first connection, a flocculating preparation chemical such as, for instance, sodium hydroxide being added through this connection. Upon further flow the liquid to be treated is intimately mixed with the flocculation preparation chemical. As soon as this pretreated liquid comes into the vicinity of the following connection another flocculation preparation chemical is added. This chemical can, for instance, be an electrolyte solution which brings the pH to about 7. After passage of the liquid which has been treated with the flocculation preparation chemicals, the flocculating agent is then added in the initial region of flow of the subsequent chamber through the last connection which is there. The final treatment of the liquid flowing through the last chamber now takes place. Despite its small structural shape and multi-chamber processing the container operates with a high output. Although the chambers and the feed channel are in communication with each other, the surprising effect is obtained that there is no back-mixing or backing up from one chamber into the other.

Thus flow and vibrations of the container are so combined with each other that, on the one hand, they assure good mixing and, on the other hand, prevent so-called back-mixing. The frequency of vibration is within the range of 13 to 34 Hz and the amplitude is from 3 to 8 mm.

One advantageous embodiment is that the chambers lie in labyrinth configuration with respect to each other and are formed by partition walls which overlap in the vertical direction. Although the directions of flow in the adjacent chambers are in each case opposite to each other, no back-mixing or backing up from one chamber into the other can take place as a result of the labyrinth-like arrangement of the chambers and the feed channel.

It has been found advantageous for the first connection to be arranged in the initial region of the feed channel and for the connection of the adjoining chamber to lie near the bottom of the container at the height of the opening passage cross section from the feed channel to the first chamber which opening is left free by the first partition. The processing path is thereby lengthened by the length of the feed channel. Furthermore, the flow is promoted by the connection and communicating with the opening passage provided in transfer cross section.

In order to obtain particularly good flocculation, the connection for the addition of the flocculating agent is arranged in and communicates with the upper region of the container and the flocculation zone which adjoins it extends over several chambers.

In order that to be able to eliminate any possible sediment within the container after a certan period of use, a removal opening is formed in the bottom of the container within the region of the opening passage cross section between the two following downstream chambers and a closable discharge connection is provided in the bottom below the open passage cross section which is formed by the first partition wall. If necessary, coarse particles or gravel-like abrasive grit can be discharged through the opened outlet nipple.

Another variant is characterized by the fact that the individual chambers are arranged helically one behind the other. One chamber may in this case extend over one helical turn. In this embodiment also there is no undesired back-mixing of the liquid to be treated.

Structural advantages are obtained by having the helical chambers surround the concentrically located feed channel. The central space inwardly of the chambers is therefore utilized for the provision of the feed channel.

In order to eliminate sedimentation in a simple manner in this embodiment also, a discharge opening is provided, here coaxial to the feed channel, below the initial region of the lowest chamber.

The manufacture of such a vibratory container is simplified by the fact that the chamber partition walls or wall are arranged continuously in helical form on the outer wall surface of an insert member of the outer housing of the container. an advantageous manner and, by their assembly alone, the interior of the favorable manner and, upon their assembly, the inside of the container is already divided into the chambers.

Finally, it is advantageous to direct the connections including the outlet radially to the outer housing of the container.

Two preferred illustrative embodiments of the invention will be described below with reference to FIGS. 1 to 4, in which.

Figure 1:
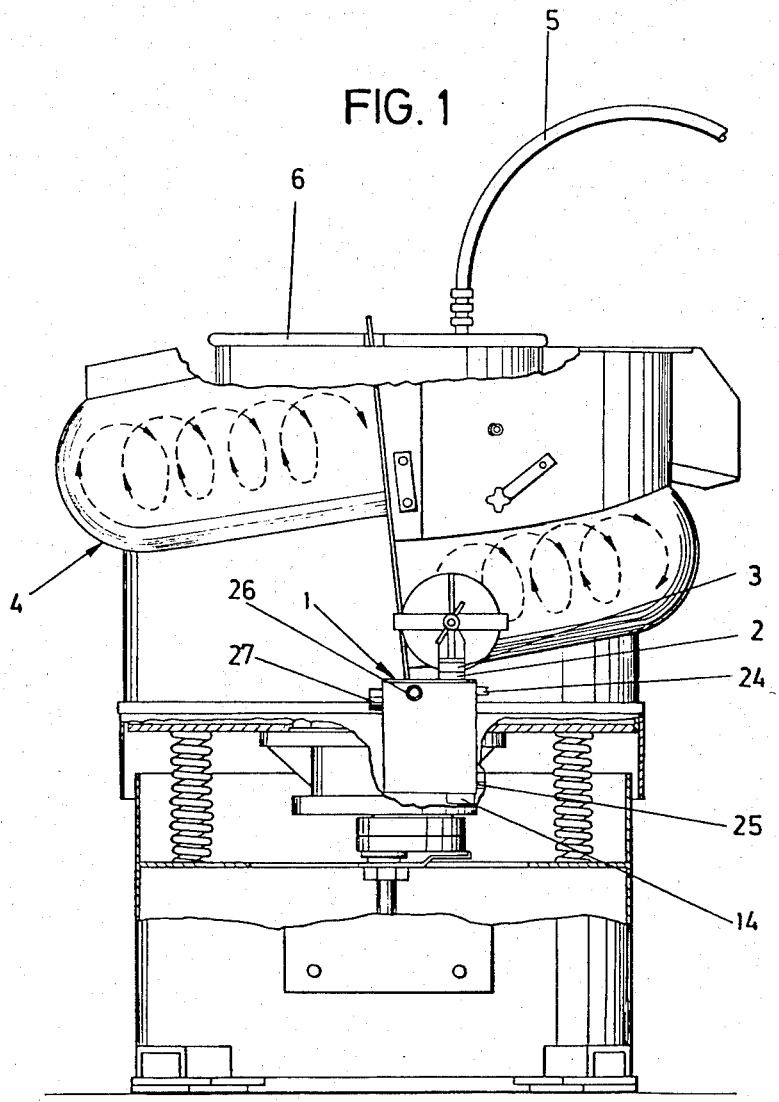
FIG. 1 is an elevation of a surface machine tool equipped with a vibratory container serving for flocculation in accordance with the first embodiment.
Figure 2:
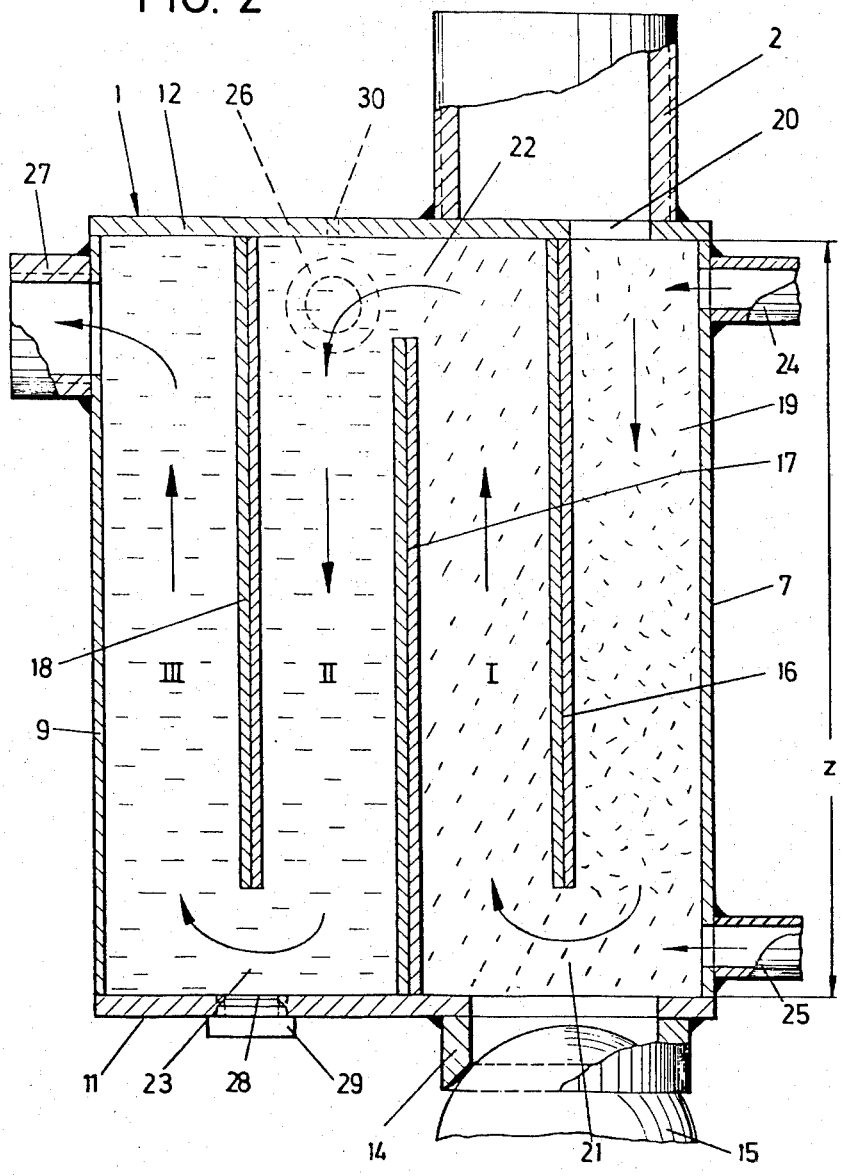
FIG. 2 is a longitudinal section through the vibratory container.
Figure 3:
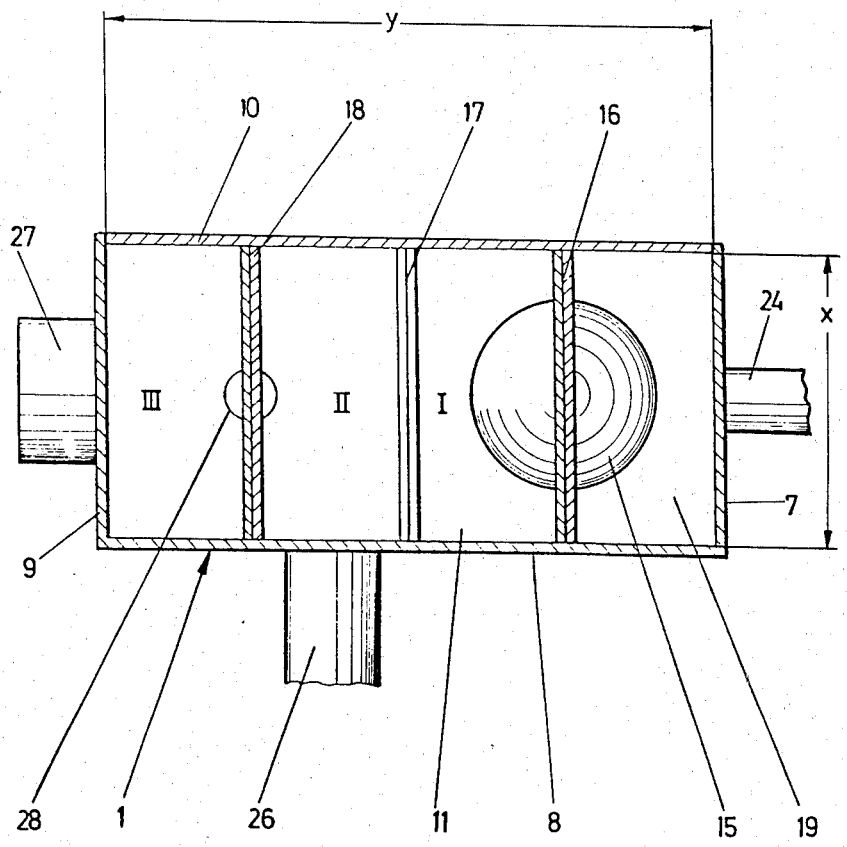
FIG. 3 is a cross section through this container in the upper region thereof.

The container 1 in accordance with the first embodiment shown in FIGS. 1 to 3 is securely fastened via a feed connection 2 to the liquid outlet 3 of a helically operating vibratory abrasive container 4 of an ordinary vibratory abrasive finishing machine. The vibratory abrasive container 4 could, however, also be of any other known shape. The working liquid which is fed via a hose 5 and an annular spray 6 can therefore flow down continuously into the container 4 and from there into the container 1. Furthermore, the container 1 vibrates together with the vibratory abrasive container.

The container 1 is of box shape. For a vibratory abrasive container 4 having a capacity of about 600 liters, the capacity of the container 1 is about 1 liter. Expressed in numbers this means that the container has about a width x of 55 mm and a length y of 120 mm, with a height z of 150 mm. The individual side walls of the container bear the reference numbers 7, 8, 9, 10, the container bottom 11 and container cover 12 being coordinated thereto. The feed connection 2 extends from the container cover 12 near the narrow container sidewall 7. Opposite the feed connection 2 there extends a discharge connection 14 which is attached to the bottom 11 of the container and can be closed by a spring biased ball 15.

The inside of the container is divided into a plurality of chambers I, II, III arranged behind and downstream of a feed channel 19 by three vertically overlapping partition walls 16, 17, 18 which are parallel to the container side walls 7 and 9. The partition wall 16 commences directly at the cover 12 of the container so that the waste water coming fom the vibratory abrasive container through the feed connection 2 flows, through the cross section of the opening 20 in the container cover 12, into the feed channel 19. The partition wall 18 which is adjacent the side wall 9 of the container also extends from the cover 12 of the container while the partition wall 17 which lies between the partition walls 16 and 18 is attached to the bottom 11 of the container. The length of the partition walls which are parallel to and approximately equally spaced from each other, is less than the height z of the container so that an opening with a transfer cross section 21 is present between the feed channel 19 and the first chamber I, an opening passage with a transfer cross section 22 is present between the first chamber I and the second chamber II and an opening passage with a transfer cross section 23 is present between the second chamber II and the third chamber III. Thus the feed channel 19 and the downstream chambers I, II and III are arranged in the form of a labyrinth with respect to each other.

In the initial region of the liquid flow the feed channel 19 communicates with a connection 24 which is fastened to the side wall 7 of the container and through which a preparation chemical can enter. In addition, another connection 25 is fastened to the lower region of this container side wall 7, at the level of the transfer cross section 21 from the feed channel 19 to the first chamber I. The connection 25 is thus arranged in the initial region of the flow through the chamber I arranged downstream behind the feed channel 19. Another flocculation preparation chemical, for instance an electrolyte solution which brings the pH of the liquid coming out of the feed channel 19 to about 7, is added through the connection 25.

As can be noted from FIG. 2, the partition 16 extends approximately along the center line of the feed connection 2 and of the discharge nippple 14. A connection 26 for the addition of the flocculating agent is arranged in the upper region of the container 1, extending in region between the two partition walls 17, 18 within the transfer cross section 22 from the first chamber I to the second chamber II. Thus the second chamber II has this connection 26 communicating therewith in the initial region of the flow through this chamber. The flocculation zone adjoining this connection 26 extends accordingly over chambers II and III. The outlet connection 27 is located at the upper end of the chamber III. It is carried by the side wall 9 of the container 1. As a result of the labyrinth-like arrangement of the partitions 16, 17, 18 in combination with the narrow side walls 7, 9 of the container the flow changes its direction as shown by the arrows in FIG. 2.

In the bottom 11 of the container in the region of the transfer cross section 23 between the two downstream flocculation chambers II and III, a removal opening 28 is provided. In normal operation it is closed by a screw plug 29.

The cover 12 of the container is provided with a vent opening 30 above the flocculation chamber II.

The waste water coming from the feed nipple 2 is subjected, throughout the container 1 which vibrates along with the vibratory abrasive container, within the feed channel 19 and in the adjacent chambers I, II, III, to treatment with the addition of suitable chemicals so that the liquid departing through the outlet connection 27 is ready for the sewage system. Although only one drive is provided for the vibrations, it is possible to employ a multi-chamber operation. There is no danger of backing up or back-mixing of liquid from one chamber into the other. The flow is therefore not detrimentally affected by the vibrations.

Figure 4:
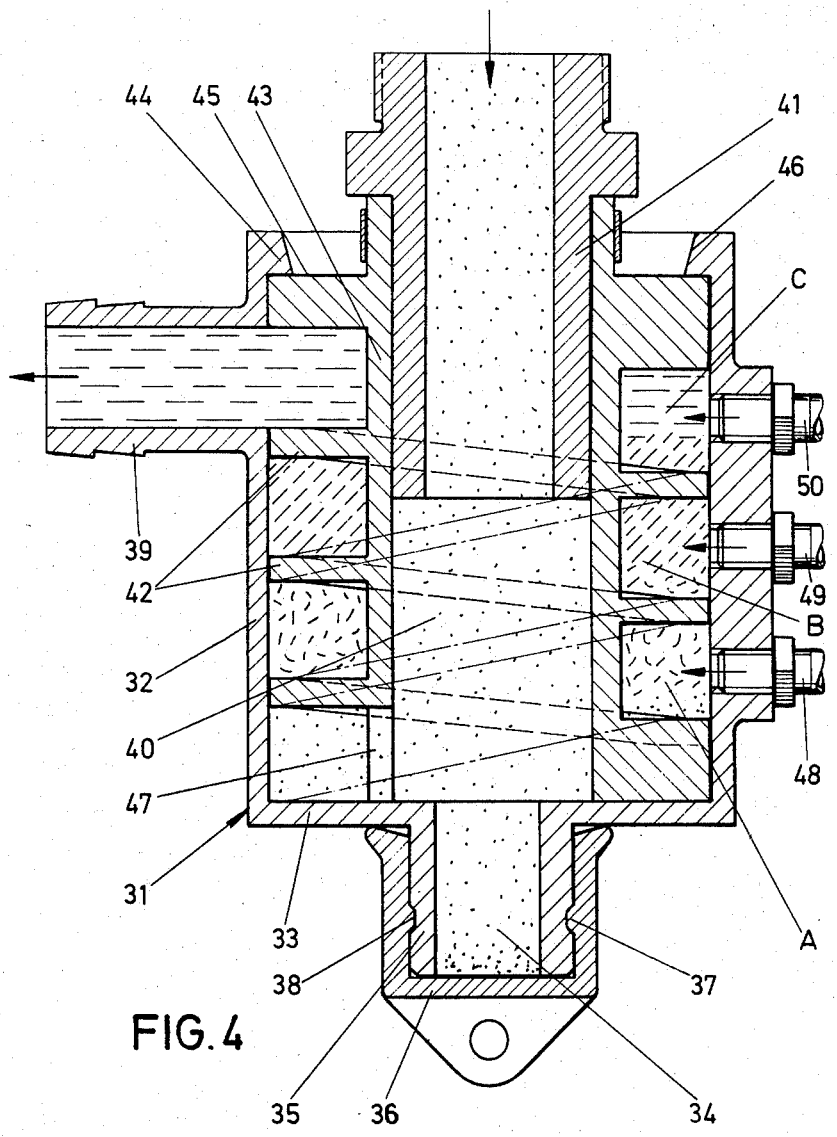
FIG. 4 is a longitudinal section through the container of the second embodiment.

The container 31 in accordance with the second embodiment, shown in FIG. 4, has a cylindrical outer housing 32. The bottom of the container is designated 33. The bottom extends in one-piece into a collar 35 which forms a removal opening 34. When the container 31 is in operation, the removal opening 34 is closed by a cap 36 which has a detent rib 37 on its inner side. This rib engages into a detent groove 38 in the outer wall of the collar 35.

An outlet connection 39 extends radially from the upper end of the container.

The inside of the container is divided into a plurality of chambers A, B and C arranged helically one downstream of other. These helical chambers surround a concentrically located feed channel 40. The afore-mentioned removal opening 34 extends, coaxial to this feed channel 40, below the initial entrance region of the lowest chamber A. A feed connection 41 which can be firmly attached to the liquid member of the vibratory abrasive container 4 enters into the upper end of the feed channel 40.

In this embodiment, a chamber partition wall 42 extends in a continuous helix on the outer wall surface of an insert piece 43 which is inserted in the outer housing 32 in such a manner that the chamber partition wall sealingly engages against the inner wall of the outer housing 32. The firm seat of the insert piece 43 within the container housing 32 is obtained by an upper clipping edge 44 of the container housing 32 which is made of resilient material, this clipping edge engaging against a stepped shoulder 45 on the insert piece. The insertion of the insert piece is facilitated by the fact that the clipping edge is formed with an insertion bevel 46.

So that the liquid from the vibratory abrasive container (not shown in FIG. 3) to be treated which enters the feed channel 40, can flow, within the region of the bottom of the container, into the lowest chamber A, the inner wall of insert piece and the chamber is provided there with a passage opening 47. From there the liquid passes in the chamber A to adjacent a connection 48 communicating with the initial region of the chamber A, through which connection a preparation chemical can enter. The treatment liquid flows helically upwardly through chamber A to a connection 49 communicating with the initial region of the second chamber B, the other flocculating preparation chemical being added through this connection. The helically upward flowing liquid continues through chamber B and then the flocculating substance is fed thereto in the initial region of chamber C through the last connection 50 which communicates with the chamber C. The treatment of the liquid treated so as to be ready for a sewage system takes place in this chamber C, the liquid leaving the container 31 through the outlet connection 39.

As can be noted from FIG. 4, the connections 48, 49 and 50 extend diametrically opposite to the outlet 39, in such a manner that the distance between the individual connections corresponds to the pitch of the chambers arranged helically downstream of each other.

We claim:

1. In a vibratory container for the flocculation of waste liquids, having a feed connection which communicates with a feed channel extending into the inside of the container, the feed channel communicating in a siphon-like manner with a waste liquid outlet of a vibrational treatment device, said container being arranged to vibrate with said treatment device, the container having a connection for the addition of a flocculating agent, and a flocculated waste liquid outlet, the improvement comprising at least one partition wall subdividing the inside of the container into a plurality of communicating chambers arranged downstream of the feed channel communicating the feed channel with said flocculated water liquid outlet to assure flocculation and prevent back-mixing as said waste liquid flows from said feed channel to said flocculated waste liquid outlet, a plurality of connection means for communicating with upstream regions of said chambers, including a first of said connection means for introduction of at least one flocculation preparation chemical into at least a first corresponding one of said chambers, and a furthest downstream of said connection means being for the addition of the flocculating agent into at least an other one of said chambers.

2. The vibratory container according to claim 1, wherein said at least one partition wall comprises spaced, vertical alternately overlapping partition walls such that three of said chambers are arranged and formed as a labyrinth with respect ot each other, and a first of said overlapping partition walls defining said feed channel, means for introducing a flocculation preparation chemical into said feed channel comprising a first connection, is arranged in an upstream region of said feed channel adjacent said feed connection, said first connection means for said first chamber is located in a bottom region of the container, said first chamber being immediately downstream of said feed channel, and said other chamber is a second chamber immediately downstream of said first chamber and said furthest downstream connection means directly communicates with said second chamber.

3. The vibratory container according to claim 2, wherein said feed channel communicates with said first of said chambers via an opening passage which is left open by said first of said overlapping partition walls, said first connection means comprises a second connection communicating with said first chamber adjacent to a bottom of the container at the level of said opening passage.

4. The vibratory container according to claim 2, wherein said feed channel communicates with said first of said chambers via a first opening passage which is left open by said first of said overlapping partition walls, said first chamber communicates with said second of said chambers via a second opening passage which is left open by a second of said overlapping partition walls, said second chamber communicates with a third of said chambers via a third opening passage which is left open by a third of said overlapping partition walls, a bottom of said container in the region of said third opening passage is formed with a removal opening, a closable discharge connection is located in a bottom of said container in a region below said first opening passage.

5. The vibratory container according to claim 4, further comprising a spring-biased ball releasably closes said discharge connection.

6. The vibratory container according to claim 1, wherein said feed channel communicates with said first of said chambers via an opening passage;

means for introducing a flocculation preparation chemical into said feed channel comprising a first connection, is arranged in an upstream region of said feed channel adjacent said feed connection; and said first connection means comprises a second connection communicating with said first chamber adjacent to a bottom region of the container at the level of said opening passage.

7. The vibratory container according to claim 6, wherein said second connection directly communicates with said feed channel at a downstream end of said feed channel and indirectly with said first chamber via said feed channel and said opening passage.

8. The vibratory container according to claim 1, wherein said first of said chambers communicates directly with said feed channel and a second of said chambers communicates directly with said first chamber, and a third of said chambers communicates directly with said second chamber, said furthest downstream connection means for feeding the flocculating agent is arranged in an upper region of the container and communicates with the upstream region of said second chamber for creating an adjoining flocculation zone which extends through said second chamber and said third chamber, said second chamber comprising said other one of said chambers.

9. The vibratory container according to claim 1, wherein said feed channel communicates with said first of said chambers via a first opening passage, said first chamber communicates with a second of said chambers via a second opening passage, said second chamber communicates with a third of said chambers via a third opening passage, a bottom of said container in the region of said third opening passage is formed with a removal opening, a closable discharge connection is located in a bottom of said container in a region below said first opening passage.

10. The vibratory container according to claim 1, wherein said chambers are arranged helically, communicating with each other one downstream of the other, respectively.

11. The vibratory container according to claim 10, wherein said helical chambers are concentric to said feed channel.

12. The vibratory container according to claim 11, wherein said container is formed with a removal opening coaxial to and communicating with the feed channel below an upstream portion of said first chamber, said first chamber being a lowest and furthest upstream of said plurality of communicating chambers, said first chamber communicating with said feed channel.

13. The vibratory container according to claim 11, wherein said container comprises an outer housing and an insert member assembled in said outer housing, said partition wall is a single helical wall and extends in a continuous helix on an outer wall surface of said insert member, said feed channel is formed inside said insert member and said channels are formed by said helix between said outer housing and said insert member.

14. The vibratory container according to claim 10, wherein said container comprises an outer housing, all of said connection means and said outlet are radially directed relative to the outer housing of the container.

15. The vibratory container according to claim 10, wherein said first connection means comprises a first connection and a second connection communicating with said first and a second downstream of said chambers, respectively.

* * * * *